US006198405B1

(12) United States Patent
Andersson et al.

(10) Patent No.: US 6,198,405 B1
(45) Date of Patent: Mar. 6, 2001

(54) DRIVER CIRCUIT AND METHOD OF OPERATING THE SAME

(75) Inventors: Håkan Andersson, Malmö; Johan Uggmark, Lund, both of (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/002,371

(22) Filed: Jan. 2, 1998

(30) Foreign Application Priority Data

Jan. 3, 1997 (SE) ..... 9700013

(51) Int. Cl.[7] ..... G08B 5/22; G08B 3/10

(52) U.S. Cl. ..... 340/815.45; 340/331; 340/691.1; 340/384.72; 340/384.71

(58) Field of Search ..... 340/815.45, 331, 340/332, 326, 474, 692, 691.1, 384.6, 384.7, 384.73, 384.72, 384.4, 384.71; 362/800

(56) References Cited

U.S. PATENT DOCUMENTS

| | | | | |
|---|---|---|---|---|
| 3,810,149 | * | 5/1974 | Miller et al. | 340/326 |
| 3,944,854 | | 3/1976 | Keller | 307/311 |
| 4,274,084 | * | 6/1981 | Haus | 340/326 |
| 4,673,865 | | 6/1987 | DeLuca et al. | 323/222 |
| 4,805,739 | * | 2/1989 | Lind et al. | 187/121 |
| 4,939,402 | * | 7/1990 | Hirayama et al. | 310/316 |
| 5,005,007 | | 4/1991 | Weng et al. | 340/650 |
| 5,313,141 | | 5/1994 | Kimball | 315/169.3 |

FOREIGN PATENT DOCUMENTS

| | | |
|---|---|---|
| 2 255 822 | 5/1973 | (DE) . |
| 2 172 120 | 9/1986 | (GB) . |

* cited by examiner

*Primary Examiner*—Donnie L. Crosland
(74) *Attorney, Agent, or Firm*—Burns, Doane, Swecker & Mathis, L.L.P.

(57) ABSTRACT

A driver circuit 1000 for driving functional devices, such as an LED 1020–1023, a buzzer 1060, a voltage converter or an EL-lamp, and a method of operating the driver circuit are provided. The circuit includes an inductor 1030, first and second connection points for connection of a voltage source 1050, switching means 1040 which when in a first state allows an electrical current to flow from the first connection point and through the inductor to thereby charge the inductor with energy and when in a second state substantially prevents an electrical current from flowing from the first connection point to the inductor and at least two functional devices, the function of which are activated when energy is discharged from the inductor to the at least two functional devices.

18 Claims, 12 Drawing Sheets

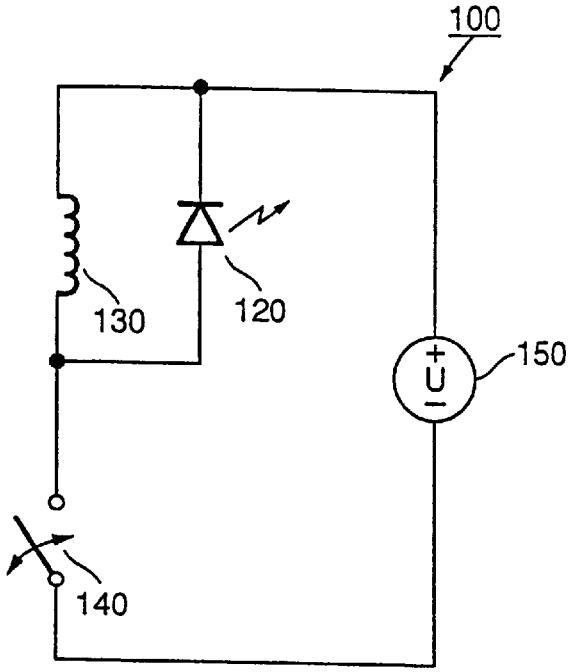
(Prior art) Fig. 1
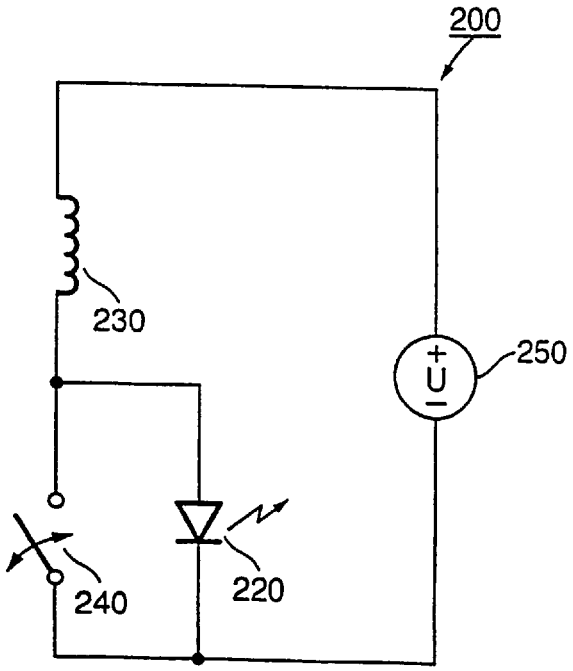
(Prior art) Fig. 2

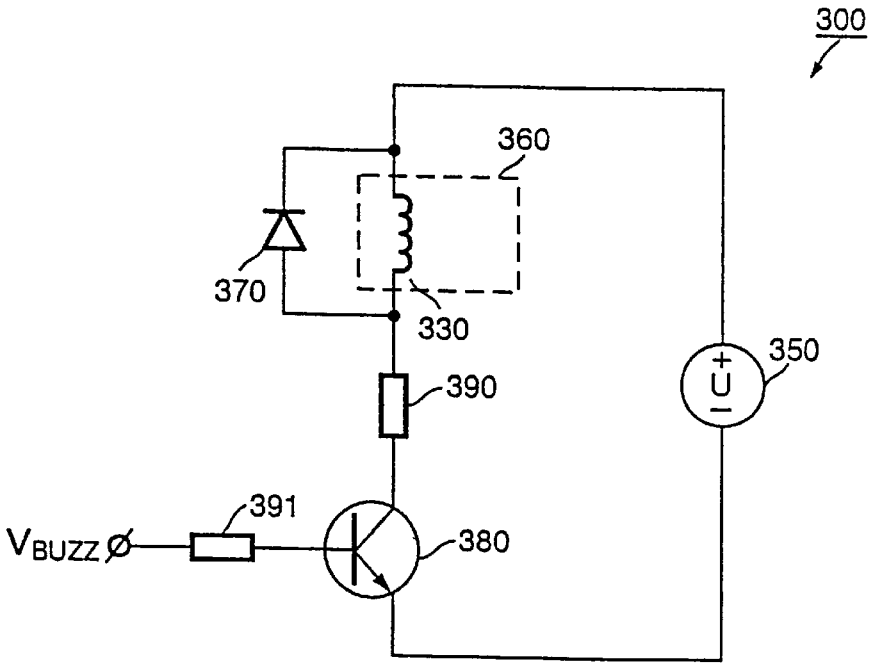
(Prior art) Fig. 3
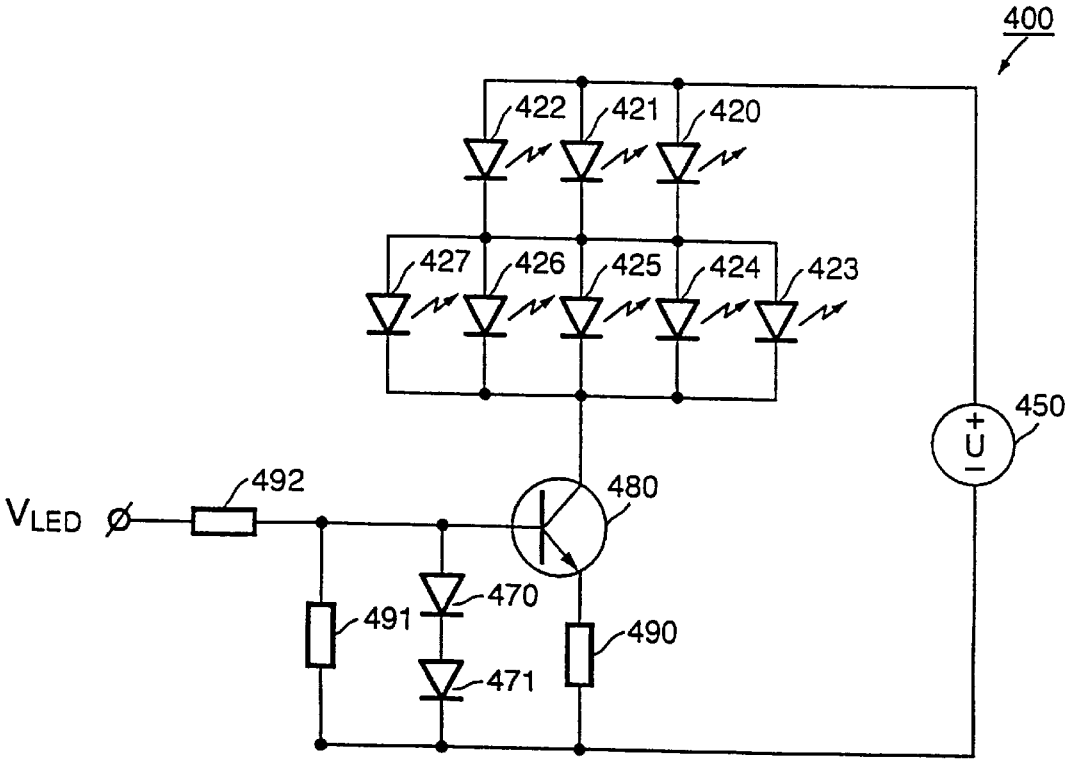
(Prior art) Fig. 4

DRIVER CIRCUIT AND METHOD OF OPERATING THE SAME

TECHNICAL FIELD OF THE INVENTION

The present invention refers to a driver circuit having an inductor, first and second connection points for connection of a voltage source, switching means which when in a first state allows an electrical current to flow from the first connection point and through the inductor to thereby charge the inductor with energy and when in a second state substantially prevents an electrical current from flowing from the first connection point to the inductor. It also refers to a method of operating the same.

DESCRIPTION OF THE PRIOR ART

Drivers for Light Emitting Diodes, LED's, are well known in the prior art.

A first type of LED driver comprises a resistor, an LED and a switch connected to a voltage source. A first electrode of the resistor is connected to the anode of the LED. The cathode of the LED is connected to a first electrode of the switch. The electrode of the voltage source having the most positive potential, "plus-pole", is connected to the second electrode of the resistor and the electrode of the voltage source having the most negative potential, "minus-pole", is connected to the second electrode of the switch. The switch may be an n-type bipolar transistor where its first electrode is the collector and its second electrode is the emitter.

In operation, when the switch is closed, i.e. conducting, a current flows from the "plus-pole" of the voltage source through the resistor, the LED and the switch to the "minus-pole" of the voltage source. If the value of the resistor and the voltage of the voltage source is chosen properly, the LED will emit light. This occurs when the voltage over the LED is greater than the threshold voltage of the diode when forward biased. This voltage, referred to as $V_F$, is about 1 to 2 V. The resistor is employed to limit the current in the circuit. The switch may be realized by, for example, a bipolar transistor or a Field Effect Transistor, FET.

A drawback with the first type of LED driver is that the LED requires a minimum voltage in the forward direction to emit light. Furthermore, the current limiting resistor will consume power which will be wasted. These drawbacks become more pronounced when the voltage source is a battery where the maximum voltage supplied is limited and the energy stored in the battery is a scarce resource. If $V_F$ is 1.4 V and a bipolar transistor, for which the potential between the collector and the emitter is 0.2 V when the transistor is conducting, is used as a switch, the voltage of the voltage source needs to be more than 1.6 V (1.4+0.2). In this case it would not be possible to use a battery providing a voltage of 1.5 V. The situation becomes even worse if two or more LED's are connected in series. Even if the voltage of the voltage source is sufficiently high to allow the LED to emit light, energy is wasted in the resistor. This is undesired since the available amount of energy which is stored in the battery is limited.

A first solution to the above mentioned problems is presented in DE-A-22 55 822. Disclosed herein is a driver which comprises an LED, a bipolar transistor acting as a switch and an inductor connected to a voltage source. The LED and the inductor are connected in parallel. The anode of the LED is connected to the collector of an n-type bipolar transistor. The electrode of the voltage source having the most positive potential, "plus-pole", is connected to the cathode of the LED and the electrode of the voltage source having the most negative potential, "minus-pole", is connected to the emitter of the bipolar transistor.

In operation, the transistor is used as a switch which is alternately closed and opened. This is achieved by the application of an appropriate signal on the base of the transistor. During the period when the switch is closed energy is stored in the inductor. Thereafter, when the switch is opened, the stored energy is released through the LED. If the parameters of the inductor are appropriately chosen, the voltage over the LED in the forward direction will reach the threshold voltage $V_F$ and the LED will emit light. The switch is then closed again to repeat the sequence described above. It should be noted that the maximum voltage over the LED in the forward direction may have a greater nominal value than the nominal value of the voltage supplied by the voltage source. It is thereby possible to drive an LED using a voltage source supplying a voltage which has a smaller nominal value than the threshold voltage $V_F$ of the LED. Furthermore, this solution does not include any current limiting resistor in which power is wasted.

A second solution to the above mentioned problems is disclosed in U.S. Pat. No. 3,944,854. Disclosed herein is a driver which comprises an LED, a bipolar transistor acting as a switch and an inductor connected to a voltage source. In this case the LED is connected in parallel with the switch. The operation of the driver is thus similar to the operation of the driver disclosed in DE-A-22 55 822 above.

A driver of an electroluminescent lamp, EL-lamp, comprising a switching circuit and an inductor is disclosed in U.S. Pat. No. 5,313,141.

Drivers for buzzers are well known in the prior art.

A buzzer comprises an inductor and a membrane. In operation an electrical potential, which alternates periodically, is applied over the inductor and a magnetic field having a periodically changing strength is thereby created in the vicinity of the inductor. The membrane, which is physically placed adjacent to the inductor, is made to vibrate due to these changes in the strength of the magnetic field. These vibrations of the membrane generates an acoustic signal. The operation of a buzzer is thus similar to the operation of a loudspeaker.

A prior art buzzer driver comprises a buzzer, a transistor, a resistor, a diode and an n-type bipolar transistor connected to a voltage source. A first electrode of the buzzer is connected to a first electrode of the resistor and to the anode of the diode. The second electrode of the resistor is connected to the collector of the transistor. The electrode of the voltage source having the most positive potential, "plus-pole", is connected to a second electrode of the buzzer and to the cathode of the diode. The electrode of the voltage source having the most negative potential, "minus-pole", is connected to the emitter of the transistor.

In operation, the transistor may be used as a switch which is alternately closed and opened. This is achieved by the application of an appropriate signal on the base of the transistor. A current will flow through the inductor of the buzzer when the transistor is conducting and energy will be stored in the inductor. The stored energy will be released as a current through the diode when the transistor is not conducting. The current through the inductor of the buzzer will generate a magnetic field around the inductor. The physical position of the membrane within the buzzer will depend on the strength of the magnetic field. Since the strength of the magnetic field will periodically vary as a function of time dependent on the switching of the transistor, the membrane will vibrate and thereby generate an acoustic wave. The frequency of the acoustic wave will depend on the frequency of the switching of the transistor. Other kinds of periodical signals such as a sine curve may, of course, also be used when driving the transistor.

To fully understand the background of the invention a number of prior art circuits will now be discussed.

An LED driver may be employed to drive a number of LED's. This is frequently used in the prior art when the LED's are intended to generate background light for example to a Liquid Crystal Display (LCD) or to the pads of a keyboard. One kind of a prior art LED driver for a plurality of LED's comprises a constant current generator and a plurality of LED's connected to a voltage source. A group of LED's may be connected in series or in parallel. A number of groups of LED's may then be connected in series or in parallel.

A number of voltage converters which make use of an inductor and a switch are known in the prior art. A common operational principle of these converters is that the inductor is alternately charged and discharged with energy. This is achieved by alternately closing and opening the switch.

A problem with the prior art drivers is that if more than one of the drivers are realized in a common system the total space required by the driver circuits on a Printed Circuit Board, PCB, is large. This problem becomes more acute when several driver circuits are realized in a system which need to have physically small dimensions. A system requiring such small dimensions are handheld systems (for example a cellular phone).

A further problem with the prior art drivers when they are realized in a common system is that the mounting of the components on a PCB, for example by a pick-and-place machine, takes at least the time it takes to mount all the components of each driver sequentially. The time it takes to mount a component on a PCB corresponds to a cost since a resource, such as a pick-and-place machine, will be occupied during the period of time it takes to mount the component.

A further problem with the prior art drivers when they are realized in a common system is that each of the drivers requires a separate control signal for controlling the operation of the driver. This control signal is normally generated by a control unit such as a micro-processor. Each control signal then occupies an output port of the control unit. In many systems the number of output ports of the control unit is a scarce resource. This problem becomes even more acute when the control unit is to be fitted into a physically small application, such as a handheld system, because each output port occupies a certain minimum area on the PCB.

SUMMARY

It is an object of the present invention to provide a driver circuit, for driving at least two functional means, such as an LED, a buzzer, a voltage converter or an EL-lamp, which, when implemented, requires a small space on a PCB.

It is a further object of the present invention to provide a driver circuit for driving at least two functional means which, when the components thereof are mounted on a PCB, requires little time by a resource for mounting the components on the PCB, such as a pick-and-place machine.

It is a further object of the present invention to provide a driver circuit for driving a number of functional means which are controlled through a small number of control signal lines. It is an object of the present invention to have a smaller number of control signal lines than the number of functional means thereby allowing a small number of output ports of a control unit to be used with the result that the output ports and the control signal lines require, when implemented, a small space on a PCB.

The objects of the present invention are achieved by providing a driver circuit, for driving at least two functional means, such as an LED, a buzzer, a voltage converter or an EL-lamp, having an inductor, first and second connection points for connection of a voltage source, switching means which when in a first state allows an electrical current to flow from the first connection point and through the inductor to thereby charge the inductor with energy and when in a second state substantially prevents an electrical current from flowing from the first connection point to the inductor and at least two functional means, the functions of which are activated when energy is discharged from the inductor to the at least two functional means.

The present invention also provides a method of operating such a driver circuit comprising the steps of first setting the switching means in its first state for allowing an electrical current to flow from the first connection point and through the inductor to thereby charge the inductor with energy and thereafter setting the switching means in its second state for allowing energy stored in the inductor to discharge to the functional means.

This construction achieves the advantage that the space on a PCB required by two or more drivers is smaller than when the same number of drivers are realized separately since a smaller number of components are required.

Furthermore, the construction achieves the advantage that, when the components of the driver circuit for driving at least two functional means are mounted on a PCB, less time is required by a resource for mounting the components on a PCB, such as a pick-and-place machine, since a smaller number of components are required compared to when the same number of drivers are realized separately.

Furthermore, the construction achieves the advantage that a smaller number of signals for controlling the drivers are required compared to the number of signals for controlling the same number of drivers when these are realized separately.

The smaller space required on the PCB is the result of the fact that a smaller number of components (inductors and switches) are needed for the driver circuit of the present invention compared to the number of components needed for the prior art drivers when the same amount of drivers are used. Furthermore, the required space on the PCB is also reduced due to the fact that a smaller number of control signal lines need to be realized on the PCB. When these control signal lines are generated by output ports of for example a micro-processor the PCB space required is further reduced because a smaller number of output ports need to be realized on the PCB. The smaller number of control signal lines and possibly the number of output ports required is also a result of the method of operating the driver circuit of the present invention where the operation of more than one functional means may be controlled by the use of one control signal by changing the frequency of the control signal.

BRIEF DESCRIPTION OF THE DRAWINGS

The foregoing, and other, objects, features and advantages of the present invention will be more readily understood upon reading the following detailed description in conjunction with the drawings, in which:

FIG. 1 illustrates a circuit diagram of a first prior art LED driver using an inductor;

FIG. 2 illustrates a circuit diagram of a second prior art LED driver using an inductor;

FIG. 3 illustrates a circuit diagram of a prior art buzzer driver;

FIG. 4 illustrates a circuit diagram of a prior art LED driver;

DETAILED DESCRIPTION OF EMBODIMENTS

Figure 5:
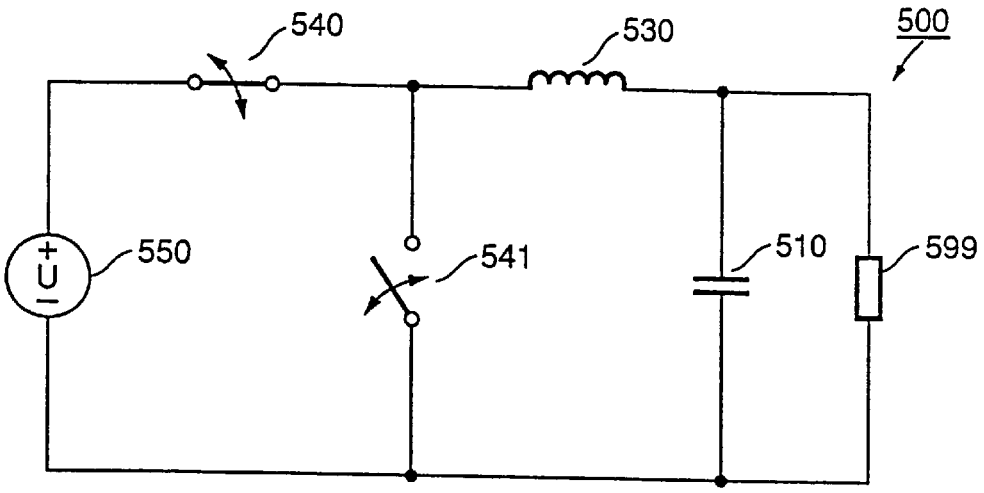
(Prior art) Fig. 5
FIG. 5 illustrates a circuit diagram of a prior art step-down circuit.

In the following description, for purposes of explanation and not limitation, specific details are set forth, such as particular circuits, circuit components, techniques, etc. in order to provide a thorough understanding of the present invention. However, it will be apparent to those skilled in the art that the present invention may be practiced in other embodiments that depart from these specific details. In other instances, detailed descriptions of well-known methods, devices and circuits are omitted so as no to obscure the description of the present invention with unnecessary detail.

FIG. 1 illustrates a first prior art LED driver 100 which comprises an LED 120, a switch 140 and an inductor 130 connected to a voltage source 150. The voltage source 150 has a first electrode for the most positive potential, "plus-pole", and a second electrode for the most negative potential, "minus-pole". The voltage source 150 may comprise one or a number of battery cells or be constituted by other means known to man skilled in the art. The LED 120 and the inductor 130 are connected in parallel. The anode of the LED 120 is connected to a first electrode of a switch 140. The electrode of the voltage source 150 having the most positive potential, the "plus-pole", is connected to the cathode of the LED 120 and the electrode of the voltage source 150 having the most negative potential, "minus-pole", is connected to a second electrode of the switch 140.

In operation, the switch 140 is alternately closed and opened. During the period when the switch 140 is closed energy is stored in the inductor 130. Thereafter, when the switch 140 is opened, the stored energy is released through the LED 120. If the parameters of the inductor 130 are appropriately chosen, the maximum voltage over the LED 120 in the forward direction will reach the threshold voltage $V_F$ of the LED and the LED 120 will emit light. The switch 140 is then closed again to repeat the sequence described above. It should be noted that the threshold voltage over the LED 120 may have a greater nominal value than the nominal value of the voltage supplied by the voltage source 150. It is thereby possible to drive an LED using a voltage source supplying a voltage which has a smaller nominal value than the threshold voltage $V_F$ of the LED. Furthermore, this solution does not include any current limiting resistor in which power is wasted. However, a resistor is sometimes included to limit the level of the current-peaks from the voltage source 150.

FIG. 2 illustrates a second prior art LED driver 200 which comprises an LED 220, a switch 240 and an inductor 230 connected to a voltage source 250. The anode of the LED 220 is connected to a first electrode of the switch 240 and a first electrode of the inductor 230. The electrode of the voltage source 250 having the most positive potential, the "plus-pole", is connected to a second electrode of the inductor 230 and the electrode of the voltage source 250 having the most negative potential, the "minus-pole", is connected to a second electrode of the switch 240 and to the cathode of the LED 220.

In operation, the switch 240 is alternately closed and opened. During the period when the switch 240 is closed energy is stored in the inductor 230. Thereafter, when the switch 240 is opened, the stored energy is released through the LED 220. If the parameters of the inductor 230 are appropriately chosen, the voltage over the LED 220 in the forward direction will reach the threshold voltage $V_F$ and the LED 220 will emit light. The switch 240 is then closed again to repeat the sequence described above. It should be noted that the maximum voltage over the LED 220 in the forward direction may have a greater nominal value than the nominal value of the voltage supplied by the voltage source 250. It is thereby possible to drive an LED using a voltage source supplying a voltage which has a smaller nominal value than the threshold voltage $V_F$ of the LED. Furthermore, this solution does not include any current limiting resistor in which power is wasted. However, a resistor is sometimes included to limit the level of the current-peaks from the voltage source 250.

FIG. 3 illustrates a circuit diagram of a prior art buzzer driver 300 which comprises a buzzer 360 having an inductor 330, a transistor 380, a resistor 390, a diode 370 and an n-type bipolar transistor 380 connected to a voltage source 350. A first electrode of the buzzer 360 is connected to a first electrode of the resistor 390 and to the anode of the diode 370. The second electrode of the resistor 390 is connected to the collector of the transistor 380. The electrode of the voltage source 350 having the most positive potential, "plus-pole", is connected to a second electrode of the buzzer 360 and to the cathode of the diode 370. The electrode of the voltage source 350 having the most negative potential, "minus-pole", is connected to the emitter of the transistor 380.

In operation, the transistor 380 may be used as a switch which is alternately closed and opened. This is achieved by the application of an appropriate signal on the base of the transistor 380. For example, an electrical potential $V_{Buzz}$ varying according to a square wave or a sine wave is connected to the base of the transistor 380 through a current limiting resistor 391. A current will flow through the inductor 330 of the buzzer 360 when the transistor 380 is conducting and energy will be stored in the inductor 330. The stored energy will be released as a current through the diode 370 when the transistor 380 is not conducting. The current through the inductor 330 of the buzzer 360 will generate a magnetic field around the inductor. The physical position of the membrane (not shown) within the buzzer 360 will depend on the strength of the magnetic field. Since the strength of the magnetic field will periodically vary as a function of time dependent on the switching of the transistor 380, the membrane will vibrate and thereby generate an acoustic wave. The frequency of the acoustic wave will depend on the frequency of the switching of the transistor. Other kinds of periodical signals may also be used when driving the transistor.

FIG. 4 illustrates a circuit diagram of a prior art LED driver 400 for a plurality of LED's which comprises a constant current generator and a plurality of LED's 420–427 connected to a voltage source 450. Three LED's 420–422 in a first group are connected in parallel by connecting their anodes together and their cathodes together. Five LED's 423–427 in a second group are also connected in parallel by connecting their anodes together and their cathodes together. The two groups of LED's are connected in series by connecting the cathodes of the three LED's of the first group together with the anodes of the five LED's of the second group. It should be understood that the first and second group of LED's may comprise any number of LED's and that the number of groups may be one or greater than two. The LED's are connected to a current generator which comprises an n-type bipolar transistor 480, three resistors 490, 491, 492 and two diodes 470, 471. The cathodes of the five LED's of the second group are connected to the collector of the transistor. The emitter of the transistor 480 is connected to a first electrode of a first resistor 490. The base of the transistor 480 is connected to an anode of a first diode 470, a first electrode of a second resistor 491 and a first electrode of a third resistor 492. The cathode of the first diode 470 is connected to the anode of a second diode 471. The cathode of the second diode 471, the second electrode of the first resistor 490 and the second electrode of the second resistor 491 are joined together and connected to the electrode of the voltage source 450 having the most negative potential, "minus-pole". The electrode of the voltage source 450 having the most positive potential, "plus-pole", is connected to the anodes of the first group of three LED's. The constant current generator is fed by applying an electrical potential $V_{LED}$ to the second electrode of the third resistor 492.

In operation, when a sufficiently high potential $V_{LED}$ is applied to the current generator, the potential at the base of the transistor 480 will be equal to the threshold voltage of the first and second diodes 470, 471 (normally 2×0.7 V=1.4 V). Since this potential is more or less fixed and the potential between the base and the emitter of the transistor 480 is also fixed (normally 0.7 V) the potential over the first resistor 490 will be fixed (1.4 V—0.7 V=0.7 V). The collector to emitter current can thereby be determined by selecting the value of the first resistor 490. This current will be independent of the load on the collector of the transistor 480. This arrangement thus acts as a constant current generator. A current will then flow through the LED's 420–427. If the potential of the voltage source 450 is sufficiently high and thereby the voltage over each LED 420–427 is greater than the threshold voltage $V_F$ of the diode the LED's will emit light. Since the number of LED's used in the first group and the second group of LED's are not the same the current through each of the three LED's 420–422 will be greater than the current through each of the five LED's 423–427. The three LED's of the first group of LED's 420–423 will therefore emit more light than the five LED's of the second group of LED's 424–427. When the potential applied to the current generator is sufficiently low (for example zero Volt) no collector emitter current will flow through the transistor 480 and the LED's will not emit light.

FIG. 5 illustrates a circuit diagram of a prior art positive step-down (also called a "buck") circuit 500. The circuit comprises a first and a second switch 540, 541, an inductor 530 and a capacitor 510. The circuit is connected to a voltage source 550. The electrode of the voltage source 550 having the most positive potential, "plus-pole", is connected to a first electrode of the first switch 540. The second electrode of the first switch 540 is connected to a first electrode of the inductor 530 and a first electrode of the second switch 541. The second electrode of the inductor 530 is connected to a first electrode of the capacitor 510 and to a first electrode of the load 599 of the step-down circuit. The electrode of the voltage source 550 having the most negative potential, "minus-pole", is connected to the second electrode of the second switch 541, the second electrode of the capacitor 510 and to the second electrode of the load 599 of the step-down circuit 500.

The first switch 540 is closed and the second switch 541 is open during a first period of time. A current flows from the voltage source 550 and through the inductor 530. Energy is thereby stored in the inductor 530. During a second period of time the first switch 540 is open and the second switch 541 is closed. The energy stored in the inductor 530 is discharged into the capacitor 510 and the load 599. By alternately repeating the first and the second period with a predetermined duty cycle the output voltage, i.e. the output voltage over the capacitor 510 (and the load 599) will be a positive voltage which is lower than the input voltage of the voltage source 550. The capacitor 510 reduces the amount of ripple in the output voltage.

A negative step-down circuit, also called a negative buck circuit, converts a negative input voltage to a negative output voltage which has a less negative voltage than the input voltage. This is achieved by using the same type of circuit as the positive step-down circuit but with appropriate amendments to the polarities of the potentials in the circuit.

It should be understood that the first switch 540 and/or the second switch 541 may be implemented by using bipolar transistors or FET's. The second switch 541 may be substituted by a diode. In the case of a positive step-down circuit the cathode and the anode of the diode are connected at the points where the first and the second electrodes of the second switch 541 are connected, respectively. The direction of the diode will be the opposite in the case of a negative step-down circuit.

Figure 6:
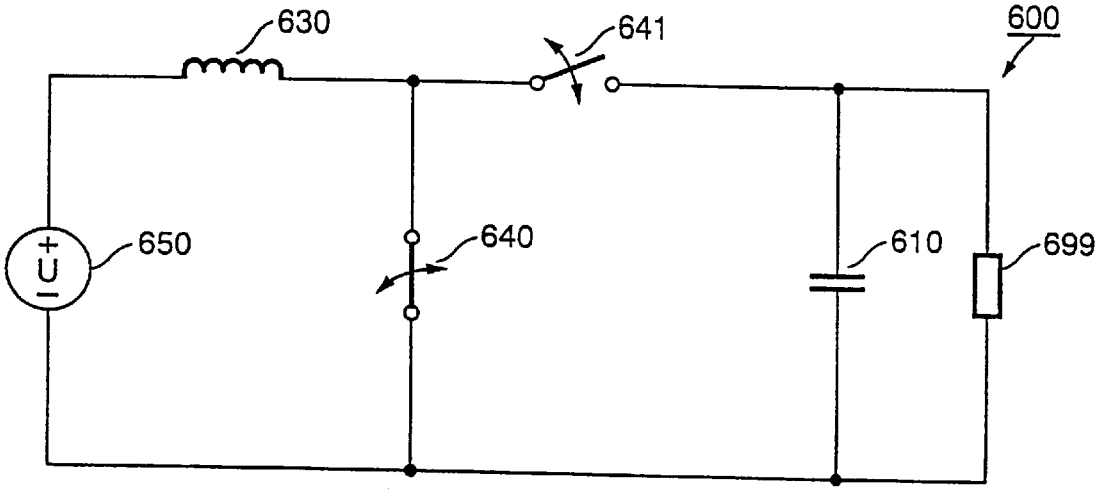
(Prior art) Fig. 6
FIG. 6 illustrates a circuit diagram of a prior art step-up circuit.

FIG. 6 illustrates a circuit diagram of a prior art positive step-up (also called a "boost") circuit 600. The circuit comprises a first and a second switch 640, 641, an inductor 630 and a capacitor 610. The circuit is connected to a voltage source 650. The electrode of the voltage source 650 having the most positive potential, "plus-pole", is connected to a first electrode of the inductor 630. The second electrode of the inductor 630 is connected to a first electrode of the first switch 640 and a first electrode of the second switch 641. The second electrode of the second switch 641 is connected to a first electrode of the capacitor 610 and to a first electrode of the load 699 of the step-up circuit 600. The electrode of the voltage source 650 having the most negative potential, "minus-pole", is connected to the second electrode of the first switch 640, the second electrode of the capacitor 610 and the second electrode of the load 699 of the step-up circuit 600.

The first switch 640 is closed and the second switch 641 is open during a first period of time. A current flows from the voltage source 650 and through the inductor 630. Energy is thereby stored in the inductor 630. During a second period of time the first switch 640 is open and the second switch 641 is closed. The energy stored in the inductor 630 is discharged into the capacitor 610 and the load 699. By repeating the operation under the first period and the second period with a predetermined duty cycle the output voltage, i.e. the output voltage over the capacitor 610 (and the load 699) will be a positive voltage which is higher than the input voltage of the voltage source 650. The capacitor 610 reduces the amount of ripple in the output voltage.

A negative step-up circuit, also called a negative boost circuit, converts a negative input voltage to a negative output voltage which has a more negative voltage than the input voltage. This is achieved by using the same type of circuit as the positive step-up circuit but with appropriate amendments to the polarities of the potentials in the circuit.

It should be understood that the first switch 640 and the second switch 641 may be implemented by using bipolar transistors or FET's. The second switch 641 may be substituted by a diode. In the case of a positive step-up circuit the anode and the cathode of the diode are connected at the points where the first and the second electrodes of the second switch 641 are connected, respectively. The direction of the diode will be the opposite in the case of a negative step-up circuit.

Figure 7:
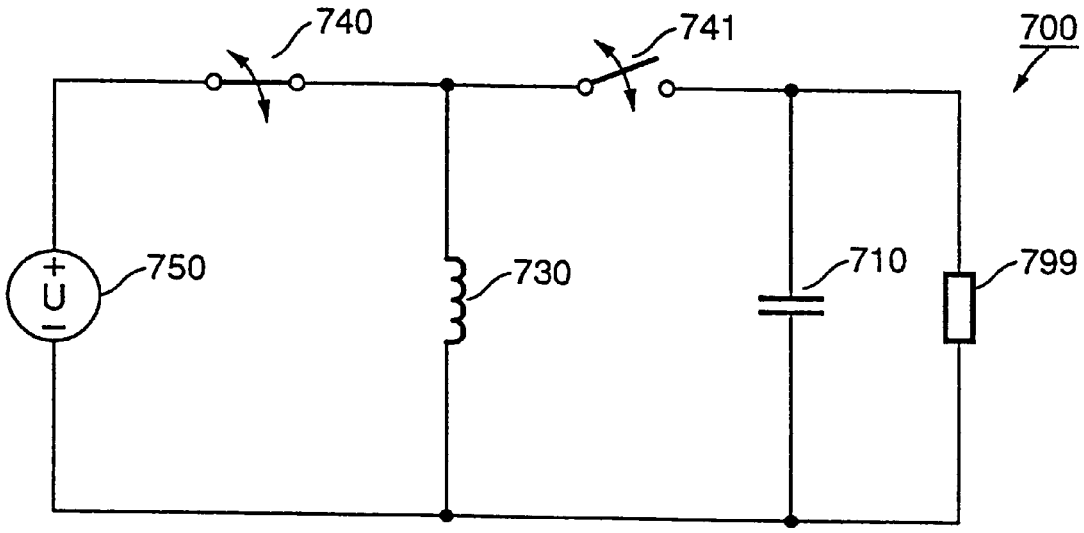
(Prior art) Fig. 7
FIG. 7 illustrates a circuit diagram of a prior art positive-to-negative polarity circuit.

FIG. 7 illustrates a circuit diagram of a prior art positive-to-negative polarity (also called a "buck-boost") circuit 700. The circuit comprises a first and a second switch 740, 741, an inductor 730 and a capacitor 710. The circuit is connected to a voltage source 750. The electrode of the voltage source 750 having the most positive potential, "plus-pole", is connected to a first electrode of the first switch 740. A second electrode of the first switch 740 is connected to a first electrode of the second switch 741 and a first electrode of the inductor 730. A second electrode of the second switch 741 is connected to a first electrode of the capacitor 710 and to a first electrode of the load 799 of the positive-to-negative polarity circuit 700. The electrode of the voltage source 750 having the most negative potential, "minus-pole", is connected to the second electrode of the inductor 730, the second electrode of the capacitor 710 and the second electrode of the load 799 of the positive-to-negative polarity circuit 700.

The first switch 740 is closed and the second switch 741 is open during a first period of time. A current flows from the voltage source 750 and through the inductor 730. Energy is thereby stored in the inductor 730. During a second period of time the first switch 740 is open and the second switch 741 is closed. The energy stored in the inductor 730 is discharged into the capacitor 710 and the load 799. By repeating the operation under the first period and the second period with a predetermined duty cycle the output voltage, i.e. the output voltage over the capacitor 710 (and the load 799) will be a negative voltage whose nominal voltage is either higher or lower than the nominal voltage of the input voltage from the voltage source 750. The capacitor 710 reduces the amount of ripple in the output voltage.

A negative-to-positive polarity circuit, also called a negative buck-boost circuit, converts a negative input voltage to a positive output voltage which has a higher or lower nominal voltage than the nominal voltage of the input voltage. This is achieved by using the same type of circuit as the positive-to-negative polarity circuit but with appropriate amendments to the polarities of the potentials in the circuit.

It should be understood that the first switch 740 and the second switch 741 may be implemented by using bipolar transistors or FET's. The second switch 741 may be substituted by a diode. In the case of a positive-to-negative polarity circuit the cathode and the anode of the diode are connected at the points where the first and the second electrodes of the second switch 741 were connected, respectively. The direction of the diode will be the opposite in the case of a negative-to-positive polarity circuit.

Figure 8:
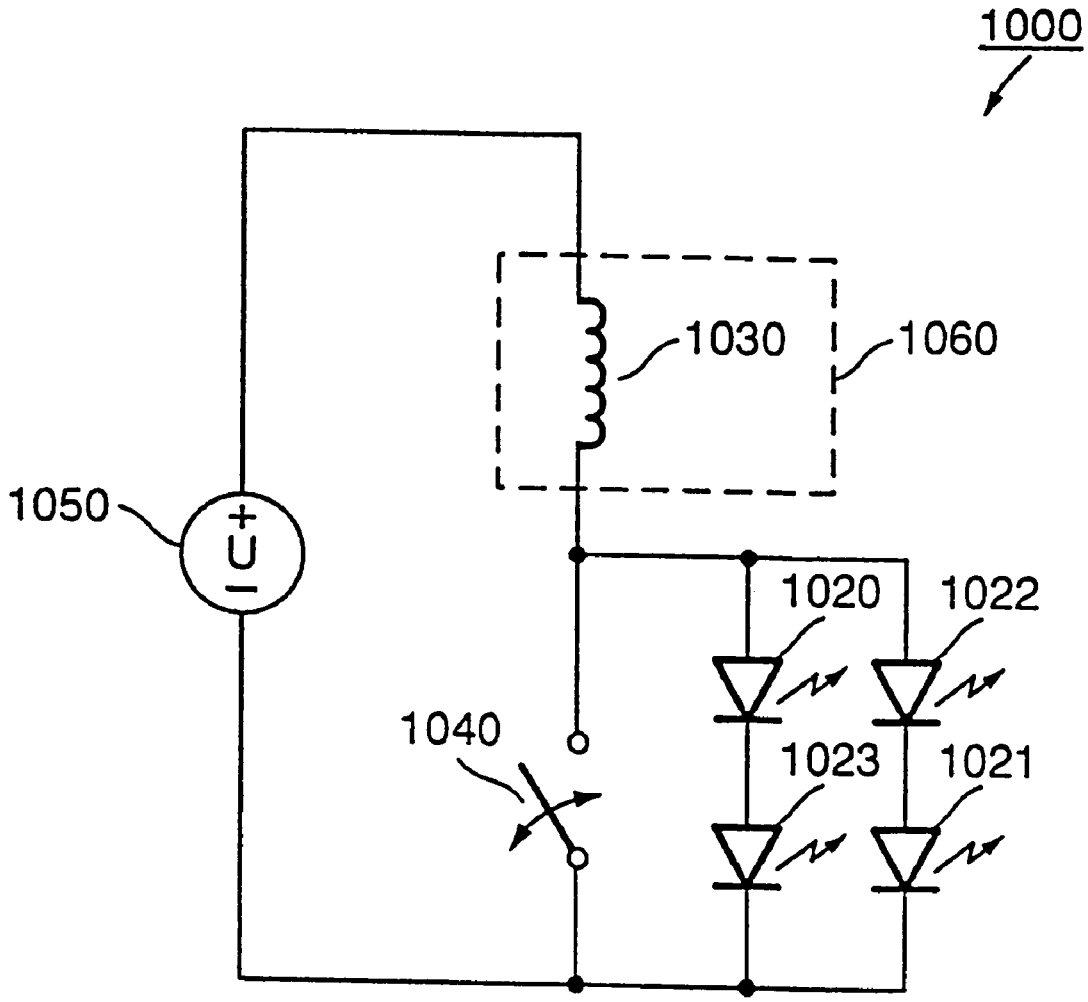
FIG. 8 illustrates a circuit diagram of an LED and buzzer driver according to a first embodiment of the present invention.

FIG. 8 illustrates a circuit diagram of an LED and buzzer driver 1000 according to a first embodiment of the present invention. The driver comprises a voltage source 1050 connected to first and second connection points (not shown), a buzzer 1060, a switch 1040 and four LED's 1020–1023. The buzzer 1060 comprises an inductor 1030 as described above. A first electrode of the inductor 1030 is connected to the electrode of the voltage source 1050 having the most positive potential, "plus-pole". A second electrode of the inductor 1030 is connected to a first electrode of the switch 1040 and to the anodes of the first and third LED's 1020, 1022. The cathodes of the first and third LED's 1020, 1022 are connected to the anodes of the second and fourth LED's 1021, 1023, respectively. The cathodes of the second and fourth LED's 1021, 1023 and a second electrode of the switch 1040 are connected to the electrode of the voltage source 1050 having the most negative potential, "minus-pole".

In operation, the switch 1040 is alternately closed and opened. During the period when the switch 1040 is closed energy is stored in the inductor 1030. Thereafter, when the switch 1040 is opened, the stored energy is released through the LED's 1020–1023. If the parameters of the inductor 1030 of the buzzer 1060 are appropriately chosen, the voltage over the LED's 1020–1023 in the forward direction will reach the threshold voltage $V_F$ of each LED and the LED's will emit light. The switch 1040 is then closed again to repeat the sequence described above. It should be noted that the maximum voltage over the LED's in the forward direction may have a greater nominal value than the nominal value of the voltage supplied by the voltage source 1050. The closing and opening of the switch 1040 will also generate a magnetic field around the inductor 1030 of the buzzer 1060. An acoustic wave will thereby be generated by a membrane (not shown) in the buzzer 1060 as described above. The frequency of this acoustic wave will be dependent on the frequency of the closing and opening of the switch 1040, i.e. the frequency with which the switch 1040 is operated.

Figure 9:
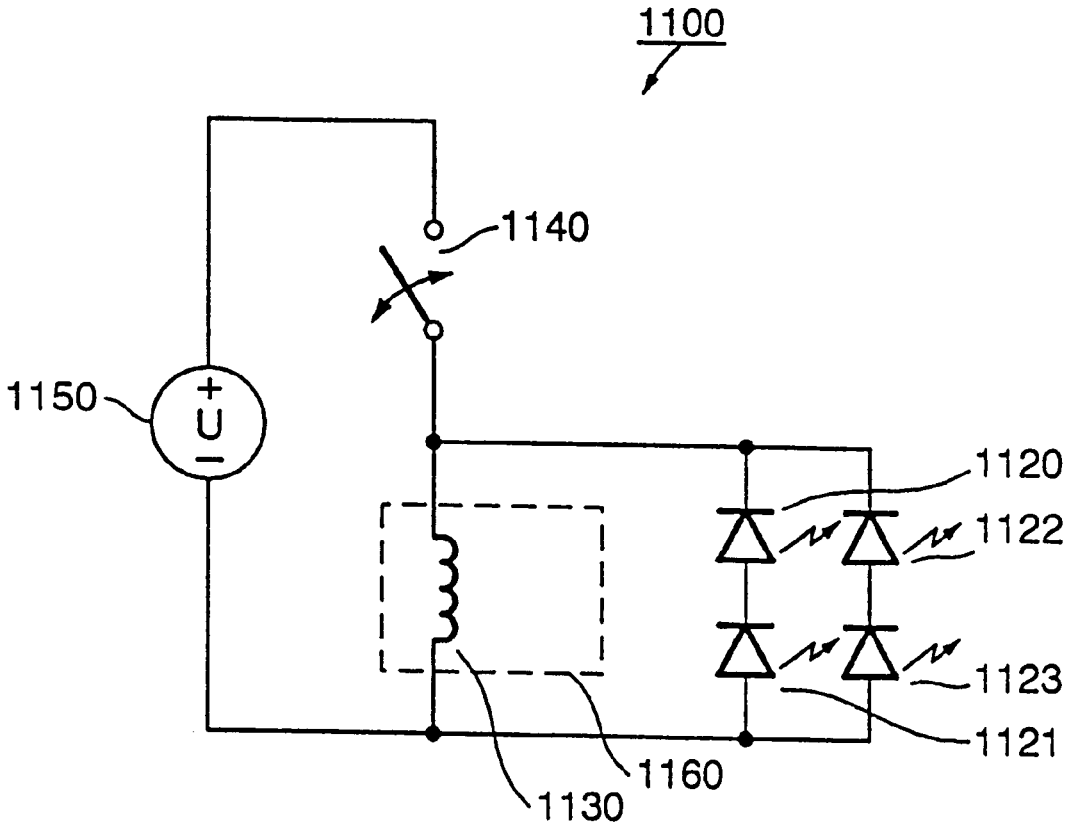
FIG. 9 illustrates a circuit diagram of an LED and buzzer driver according to a second embodiment of the present invention.

FIG. 9 illustrates a circuit diagram of an LED and buzzer driver 1100 according to a second embodiment of the present invention. The driver comprises a voltage source 1150 connected to first and second connection points (not shown), a buzzer 1160, a switch 1140 and four LED's 1120–1123. The buzzer 1160 comprises an inductor 1130 as described above. A first electrode of the switch 1140 is connected to the electrode of the voltage source 1150 having the most positive potential, "plus-pole". A second electrode of the switch 1140 is connected to a first electrode of the inductor 1130 and to the cathodes of the first and third LED's 1120, 1122. The anodes of the first and third LED's 1120, 1122 are connected to the cathodes of the second and fourth LED's 1121, 1123, respectively. The anodes of the second and fourth LED's 1121, 1123 and a second electrode of the inductor 1130 are connected to the electrode of the voltage source 1150 having the most negative potential, "minus-pole".

In operation, the switch 1140 is alternately closed and opened. During the period when the switch 1140 is closed energy is stored in the inductor 1130. Thereafter, when the switch 1140 is opened, the stored energy is released through the LED's 1120–1123. If the parameters of the inductor 1130 of the buzzer 1160 are appropriately chosen, the voltage over the LED's 1120–1123 in the forward direction will reach the threshold voltage $V_F$ of each LED and the LED's will emit light. The switch 1140 is then closed again to repeat the sequence described above. It should be noted that the maximum voltage over the LED's in the forward direction may have a greater nominal value than the nominal value of the voltage supplied by the voltage source 1150. The closing and opening of the switch 1140 will also generate a magnetic field around the inductor 1130 of the buzzer 1160. An acoustic wave will thereby be generated by a membrane (not shown) in the buzzer 1160 as described above. The frequency of this acoustic wave will be dependent on the frequency of the closing and opening of the switch 1140, i.e. the frequency with which the switch 1140 is operated.

Figure 10:
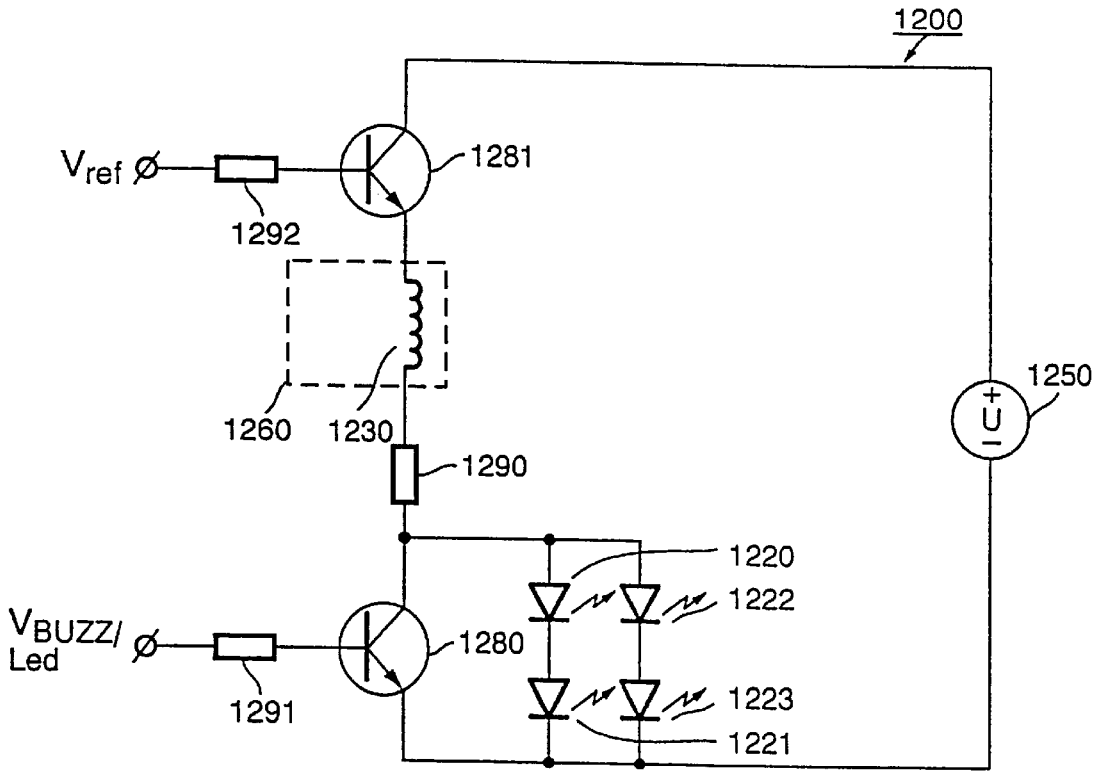
FIG. 10 illustrates a circuit diagram of an LED and buzzer driver according to a third embodiment of the present invention.

FIG. 10 illustrates a circuit diagram of an LED and buzzer driver 1200 according to a third embodiment of the present invention. The driver comprises a voltage source 1250 connected to first and second connection points (not shown), a buzzer 1260, a first n-type bipolar transistor 1280, a second n-type bipolar transistor 1281, three resistors 1290, 1291, 1292, and four LED's 1220–1223. The buzzer 1260 comprises an inductor 1230 as described above. The collector of the second transistor is connected to the electrode of the voltage source 1250 having the most positive potential, "plus-pole". A first electrode of the inductor 1230 is connected to the emitter of the second transistor 1281. A second electrode of the inductor 1230 is connected to a first electrode of a first resistor 1290. A second electrode of the first resistor 1290 is connected to the collector of the first transistor 1280 and to the anodes of the first and third LED's 1220, 1222. The cathodes of the first and third LED's 1220, 1222 are connected to the anodes of the second and fourth LED's 1221, 1223, respectively. The cathodes of the second and fourth LED's 1221, 1223 and the emitter of the first transistor 1280 are connected to the electrode of the voltage source 1250 having the most negative potential, "minus-pole". A first electrode of the second and third resistors 1291 and 1292, respectively, are connected to the base of the first and second transistors 1280 and 1281, respectively. A second electrode of the second resistor 1291 is connected to a signal labeled $V_{Buzz/Led}$ and a second electrode of the third resistor 1292 is connected to a signal labeled $V_{ref}$.

In operation, the voltage source 1250, which may be two NiMH battery cells connected in series, supplies a voltage of +2.4 V. A constant voltage of +1.6 V is applied to the signal labeled $V_{ref}$. The second transistor 1281, the third resistor 1292 in combination with the signal labeled $V_{ref}$ will act as a constant voltage generator and thereby stabilize the voltage on the emitter electrode of the second transistor 1281. The first transistor 1280 is alternately made to be conducting and to be non-conducting between the collector and the emitter. This is achieved by providing a square wave signal with a suitable voltage swing as the signal labeled $V_{Buzz/Led}$ on the second electrode of the second resistor 1291. During the period when the first transistor 1280 is conducting energy is stored in the inductor 1230. Thereafter, when the first transistor 1280 is non-conducting, the stored energy is released through the LED's 1220–1223. If the parameters of the inductor 1230 of the buzzer 1260 are appropriately chosen, the voltage over the LED's 1220–1223 in the forward direction will reach the threshold voltage $V_F$ of each LED and the LED's will emit light. The first transistor 1280 is then conducting again to repeat the sequence described above. It should be noted that the maximum voltage over the LED's in the forward direction have a greater nominal value than the nominal value of the voltage supplied by the voltage source 1250. The changing of the state of the first transistor 1280 between conducting and non-conducting will generate a magnetic field around the inductor 1230 of the buzzer 1260. An acoustic wave will thereby be generated by a membrane (not shown) in the buzzer 1260 as described above. The frequency of this acoustic wave will be dependent on the frequency of the switching of the first transistor 1280, i.e. the frequency of the signal applied to the signal labeled $V_{Buzz/Led}$.

Figure 11:
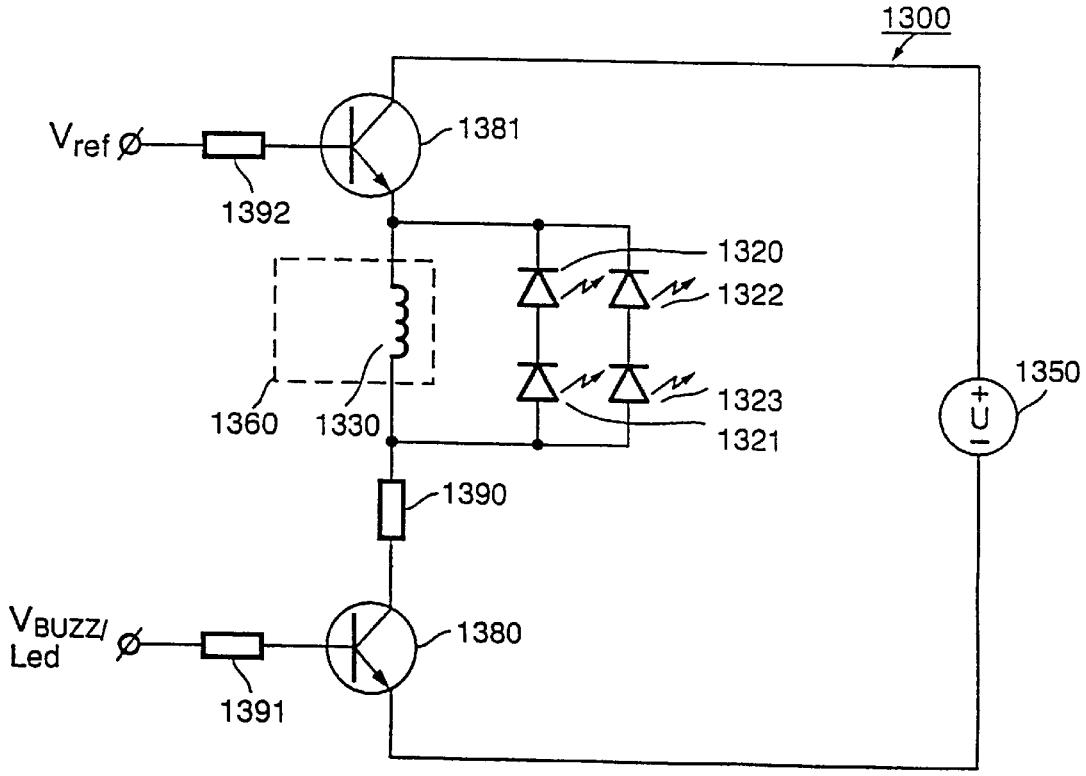
FIG. 11 illustrates a circuit diagram of an LED and buzzer driver according to a fourth embodiment of the present invention.

FIG. 11 illustrates a circuit diagram of an LED and buzzer driver 1300 according to a fourth embodiment of the present invention. The driver comprises a voltage source 1350 connected to first and second connection points (not shown), a buzzer 1360, a first n-type bipolar transistor 1380, a second n-type bipolar transistor 1381, three resistors 1390, 1391, 1392, and four LED's 1320–1323. The buzzer 1360 comprises an inductor 1330 as described above. The collector of the second transistor is connected to the electrode of the voltage source 1350 having the most positive potential, "plus-pole". A first electrode of the inductor 1330 is connected to the emitter of the second transistor 1381 and to the cathodes of the first and third LED's 1320, 1322. The anodes of the first and third LED's 1320, 1322 are connected to the cathodes of the second and fourth LED's 1321, 1323, respectively. A second electrode of the inductor 1330 is connected to a first electrode of a first resistor 1390 and to the anodes of the second and fourth LED's 1321, 1323. A second electrode of the first resistor 1390 is connected to the collector of the first transistor 1380 and the emitter of the first transistor 1380 is connected to the electrode of the voltage source 1350 having the most negative potential, "minus-pole". A first electrode of the second and third resistors 1391 and 1392, respectively, are connected to the base of the first and second transistors 1380 and 1381, respectively. A second electrode of the second resistor 1391 is connected to a signal labeled $V_{Buzz/Led}$ and a second electrode of the third resistor 1392 is connected to a signal labeled $V_{ref}$.

In operation, the voltage source which may be two NiMH battery cells connected in series, 1350 supplies a voltage of +2.4 V. A constant voltage of +1.6 V is applied to the signal labeled $V_{ref}$. The second transistor 1381, the third resistor 1392 in combination with the signal labeled $V_{ref}$ will act as a constant voltage generator and thereby stabilize the voltage on the emitter electrode of the second transistor 1381. The first transistor 1380 is alternately made to be conducting and to be non-conducting between the collector and the emitter. This is achieved by providing a square wave signal with a suitable voltage swing as the signal labeled $V_{Buzz/Led}$ on the second electrode of the second resistor 1391. During the period when the first transistor 1380 is conducting energy is stored in the inductor 1330. Thereafter, when the first transistor 1380 is non-conducting, the stored energy is released through the LED's 1320–1323. If the parameters of the inductor 1330 of the buzzer 1360 are appropriately chosen, the voltage over the LED's 1320–1323 in the forward direction will reach the threshold voltage $V_F$ of each LED and the LED's will emit light. The first transistor 1380 is then conducting again to repeat the sequence described above. It should be noted that the maximum voltage over the LED's in the forward direction may have a greater nominal value than the nominal value of the voltage supplied by the voltage source 1350. The changing of the state of the first transistor 1380 between conducting and non-conducting will also generate a magnetic field around the inductor 1330 of the buzzer 1360. An acoustic wave will thereby be generated by a membrane (not shown) in the buzzer 1360 as described above. The frequency of this acoustic wave will be dependent on the frequency of the switching of the first transistor 1380, i.e. the frequency of the signal applied to the signal labeled $V_{Buzz/Led}$.

Referring to the third and fourth embodiments as described above the constant voltage generators may be omitted. The advantage of having the constant voltage generators in the circuits is that the sound generated by the buzzers will be independent of the voltages supplied by the voltage sources. The voltage supplied by, for example, a NiMH battery depends, for instance, on the amount of energy stored in the battery. Instead of using a constant voltage generator the voltage supplied by the voltage source can be measured and this information can be used to pulse width modulate the signals labeled $V_{Buzz/Led}$ to thereby compensate for the variations on the supplied voltage. Furthermore, a man skilled in the art would appreciate that the voltage sources 1250, 1350 may be chosen to supply a voltage which is different from the voltage used in the embodiments. The potential of the signals labeled $V_{ref}$ may also be chosen differently.

In the case of the third embodiment it should be noted that the voltage supplied by the voltage source 1250 and the number of LED's connected in series preferably are chosen such that, when the first transistor 1280 is non-conducting and after the inductor 1230 has been discharge, substantially no current flows through the LED's from the voltage source 1250.

Referring to the first, second, third and fourth embodiments as described above, a man skilled in the art would appreciate that the frequency or frequencies of the acoustic wave of the buzzer 1060, 1160, 1260, 1360 may also be dependent to some extent of the ratio between the period of time the switch 1040, 1140 is closed and the period of time it is open, alternatively, the period of time the first transistor 1280, 1380 is conducting and the period of time it is non-conducting. By choosing a frequency of operation of the switch 1040, 1140, alternatively, the first transistor 1280, 1380 (for example 500 Hz), which corresponds to a frequency of an acoustic wave (for example 500 Hz) generated by the buzzer 1060, 1160, 1260, 1360 which in turn is in the audible range the LED's 1020–1023, 1120–1123, 1220–1223, 1320–1323, may be made to emit light at the same time as an audible acoustic wave is generated in the buzzer 1060, 1160, 1260, 1360. (The audible range is sometimes defined as 20–20000 Hz.) On the opposite, by choosing a frequency (for example 40000 Hz) of operation of the switch 1040, 1140, alternatively, the first transistor 1280, 1380 which corresponds to a frequency of an acoustic wave (for example 40000 Hz) generated by the buzzer 1060, 1160, 1260, 1360, which in turn is in a non-audible range the LED's 1020–1023, 1120–1123, 1220–1223, 1320–1323, may be made to emit light at the same time as no audible acoustic wave is generated in the buzzer 1060, 1160, 1260, 1360. It should be noted that most buzzers generate an acoustic wave only at frequencies below 10000 Hz. This frequency at which the buzzer does not generate an acoustic wave may therefore be used when the buzzer should be silent. When the switch 1040, 1140 remains constantly open or closed, alternatively, the first transistor 1280, 1380 is made to be constantly non-conducting or conducting the LED's are prevented from emitting light and the buzzer will not generate any acoustic waves.

Figure 12:
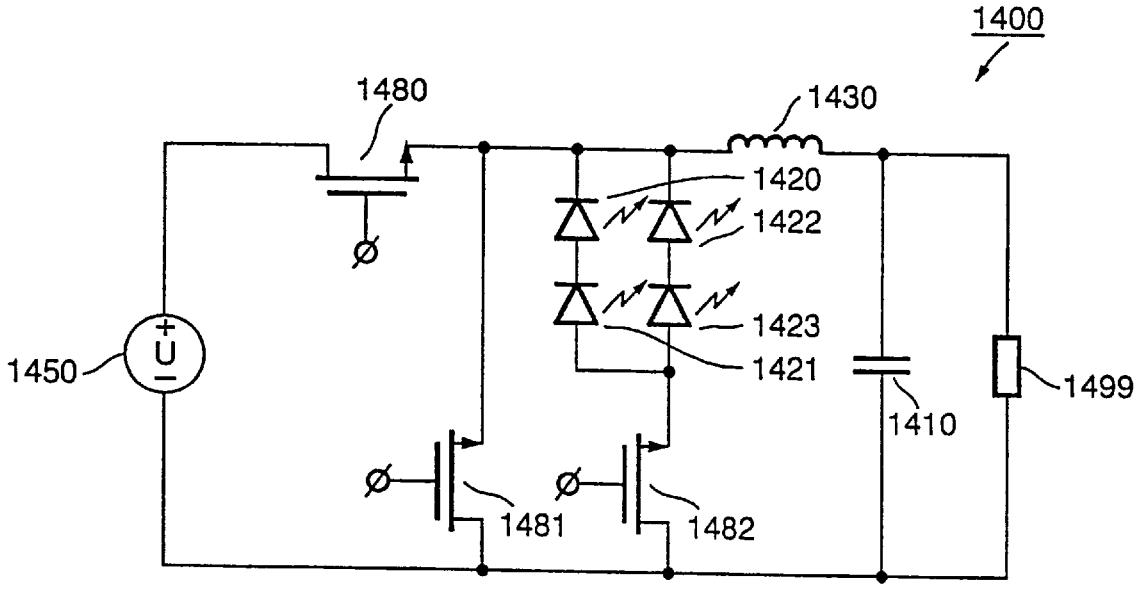
FIG. 12 illustrates a circuit diagram of an LED driver and a positive step-down circuit according to a fifth embodiment of the present invention.

FIG. 12 illustrates a circuit diagram of an LED driver and a positive step-down (also called a "buck") circuit 1400 according to a fifth embodiment of the present invention. The circuit comprises three FET's 1480, 1481, 1482, an inductor 1430, four LED's 1420–1423, and a capacitor 1410. The circuit is connected to a voltage source 1450 connected to first and second connection points (not shown). The electrode of the voltage source 1450 having the most positive potential, "plus-pole", is connected to the drain of the first transistor 1480. The drain of the first transistor 1480 is connected to a first electrode of the inductor 1430, the source of the second transistor 1481 and the cathodes of the first and third LED's 1420, 1422. The anodes of the first and third LED's, 1420 1422 are connected to the cathodes of the second and fourth LED's 1421, 1423, respectively. The anodes of the second and fourth LED's 1421, 1423 are connected to the source of the third transistor 1482. The second electrode of the inductor 1430 is connected to a first electrode of the capacitor 1410 and to a first electrode of the load 1499 of the step-down circuit. The electrode of the voltage source 1450 having the most negative potential, "minus-pole", is connected to the drain of the second transistor 1481, the drain of the third transistor 1482, the second electrode of the capacitor 1410 and to the second electrode of the load 1499 of the LED driver and step-down circuit 1400.

The voltage source 1450 supplies a voltage (for example +4.8 V). Each transistor 1480–1482 is operated to be conducting or non-conducting between the source and the drain by the application of an appropriate signal on the gate of the transistors. The operation of the circuit when the LED's should not emit light will now be described. The third transistor 1482 is non-conducting in this mode. The first transistor 1480 is conducting and the second transistor 1481 is non-conducting during a first period of time. A current flows from the voltage source 1450 and through the inductor 1430. Energy is thereby stored in the inductor 1430. During a second period of time the first transistor 1480 is non-conducting and the second transistor 1481 is conducting. The energy stored in the inductor 1430 is discharged into the capacitor 1410 and the load 1499 due to the closed circuit formed by the second transistor 1481. By alternately repeating the first and the second period with a predetermined duty cycle the output voltage, i.e. the output voltage over the capacitor 1410 (and the load 1499) will be a positive voltage (for example +3.0 V). Note that the output voltage has a lower value than the voltage of the voltage source 1450. The capacitor 1410 reduces the amount of ripple in the output voltage. In the mode when the LED's should emit light, the second transistor 1481 is kept non-conducting and the third transistor 1482 is alternating conducting and non-conducting corresponding to the switching of the second transistor 1481 in the mode when the LED's should not emit light. The closed circuit formed by the third transistor 1482 when the energy stored in the inductor 1430 is discharged will now comprise the LED's 1420–1423. During at least a part of this period the voltage over the LED's 1420–1423 in the forward direction will reach the threshold voltage of the diodes and they will then emit light.

In an alternative embodiment an LED driver and a negative step-down circuit is formed. This is achieved by using the same type of circuit as in the fifth embodiment but with appropriate amendments to the polarities of the potentials in the circuit and the directions of the transistors and the LED's.

In the case the LED's are intended to emit light at all times the second transistor 1481 and, even the third transistor 1482, may be removed.

Figure 13:
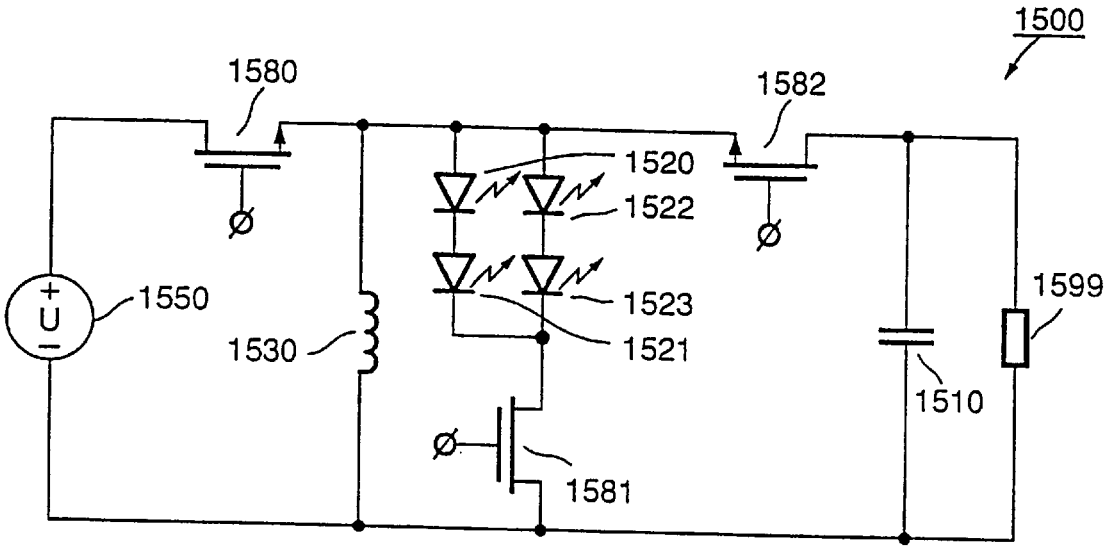
FIG. 13 illustrates a circuit diagram of an LED driver and a positive-to-negative polarity circuit according to a sixth embodiment of the present invention.

FIG. 13 illustrates a circuit diagram of an LED driver and a positive-to-negative polarity (also called a "buck-boost") circuit 1500 according to an sixth embodiment of the present invention. The circuit comprises three FET's 1580, 1581, 1582, an inductor 1530, four LED's 1520–1523 and a capacitor 1510. The circuit is connected to a voltage source 1550 connected to first and second connection points (not shown). The electrode of the voltage source 1550 having the most positive potential, "plus-pole", is connected to the drain of the first transistor 1580. The source of the first transistor 1580 is connected to a first electrode of the inductor 1530, the source of the third transistor 1582 and the cathodes of the first and third LED's 1520, 1522. The anodes of the first and third LED's 1520, 1522 are connected to the cathodes of the second and fourth LED's 1521, 1523, respectively. The anodes of the second and fourth LED's 1521, 1523 are connected to the source of the second transistor 1581. The drain of the third transistor 1582 is connected to a first electrode of the capacitor 1510 and to a first electrode of the load 1599 of the circuit 1500. The electrode of the voltage source 1550 having the most negative potential, "minus-pole", is connected to the second electrode of the inductor 1530, the drain of the second transistor 1581 and the second electrode of the capacitor 1510 and the second electrode of the load 1599 of the circuit 1500.

The voltage source 1550 supplies a voltage (for example +4.8 V). Each transistor 1580, 1581, 1582 is operated to be conducting or non-conducting between the source and the drain by the application of an appropriate signal on the gate of the transistors. The operation of the circuit when the LED's should not emit light will now be described. The second transistor 1581 is non-conducting in this mode. The first transistor 1580 is conducting and the third transistor 1582 is non-conducting during a first period of time. A current flows from the voltage source 1550 and through the inductor 1530. Energy is thereby stored in the inductor 1530. During a second period of time the first transistor 1580 is non-conducting and the third transistor 1582 is non-conducting. The energy stored in the inductor 1530 is discharged into the capacitor 1510 and the load 1599. By repeating the operation under the first period and the second period with a predetermined duty cycle the output voltage, i.e. the output voltage over the capacitor 1510 (and the load 1599) will be a negative voltage which nominal voltage is either higher or lower than the nominal voltage of the input voltage from the voltage source 1550 (for example the output voltage may be −5 V or −3 V). The capacitor 1510 reduces the amount of ripple in the output voltage. In the mode the LED's should emit light the second transistor 1581 is now and then conducting during the second period of time instead of the third transistor 1582 which then is non-conducting. Energy stored in the inductor 1530 will then be discharged through the LED's 1520–1523 instead of being discharged into the capacitor 1510 and the load 1599. For example, the third transistor 1582 may be conducting 3 times more often than the second transistor 1581 during the second period of time. This ratio between how often the second and the third transistors are conducting during the second period of time may be chosen depending on requirements on the circuit 1500. Such requirements may be the intensity of light the LED's are expected to emit and/or the amount of current that needs to be delivered to the load 1599 of the circuit 1500.

In an alternative embodiment a negative-to-positive polarity circuit is formed. This is achieved by using the same type of circuit as in the sixth embodiment but with appropriate amendments to the polarities of the potentials in the circuit and the directions of the transistors and the LED's.

Figure 14:
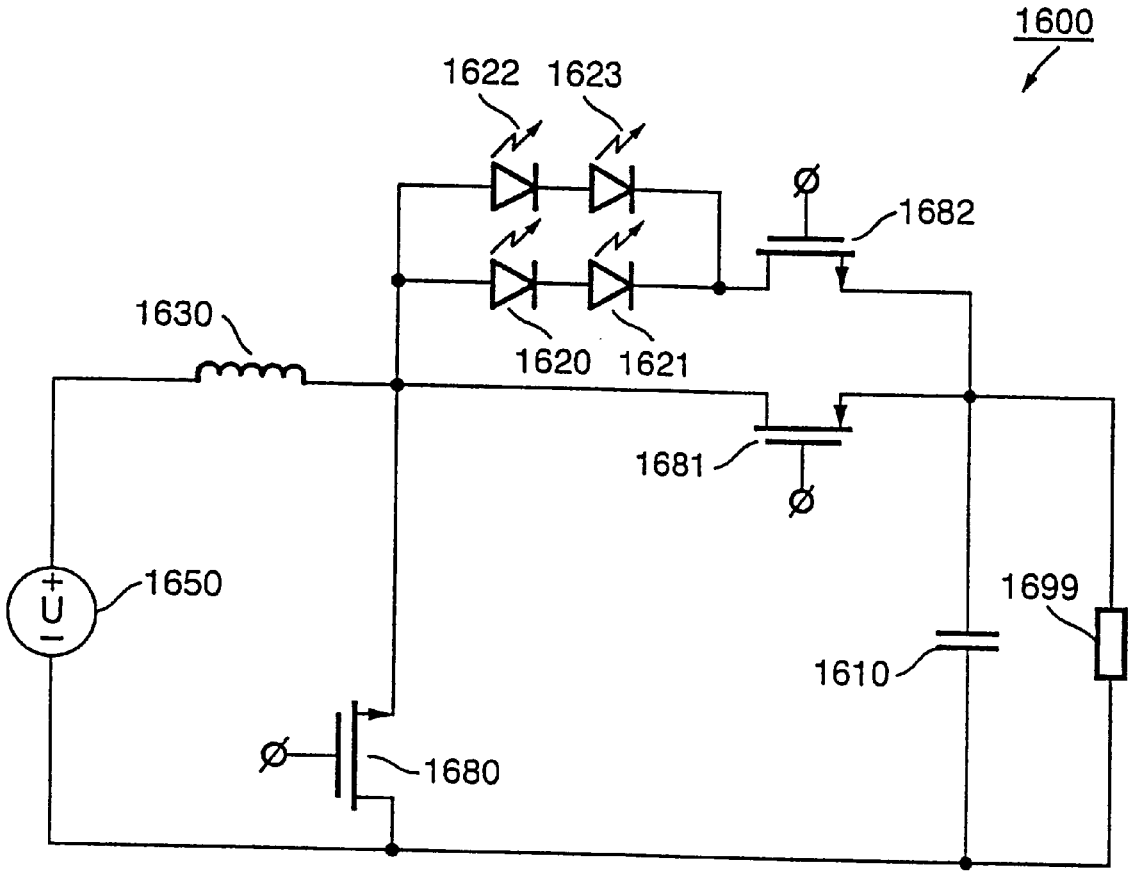
FIG. 14 illustrates a circuit diagram of an LED driver and a positive step-up circuit according to a seventh embodiment of the present invention.

FIG. 14 illustrates a circuit diagram of an LED driver and a positive step-up (also called a "boost") circuit 1600 according to a seventh embodiment of the present invention. The circuit comprises three FET's 1680, 1681, 1682, an inductor 1630, four LED's 1620–1623 and a capacitor 1610. The circuit is connected to a voltage source 1650 connected to first and second connection points (not shown). The electrode of the voltage source 1650 having the most positive potential, "plus-pole", is connected to a first electrode of the inductor 1630. The second electrode of the inductor 1630 is connected to the source of the first transistor 1680, the source of the second transistor 1681 and the anodes of the first and third LED's 1620, 1622. The cathodes of the first and third LED's 1620, 1622 are connected to the anodes of the second and fourth LED's 1621, 1623, respectively. The cathodes of the second and fourth LED's 1621, 1623 are connected to the drain of the third transistor 1682. The source of the second transistor 1681 is connected to the source of the third transistor 1682, a first electrode of the capacitor 1610 and to a first electrode of the load 1699 of the circuit 1600. The electrode of the voltage source 1650 having the most negative potential, "minus-pole", is connected to the source of the first transistor 1680, the second electrode of the capacitor 1610 and the second electrode of the load 1699 of the circuit 1600.

The voltage source 1650 supplies a voltage (for example +4.8 V). Each transistor 1680, 1681, 1682 is operated to be conducting or non-conducting between the source and the drain by the application of an appropriate signal on the gate of the transistors. The operation of the circuit when the LED's should not emit light will now be described. The third transistor 1682 is non-conducting in this mode. The first transistor 1680 is conducting and the second transistor 1681 is non-conducting during a first period of time. A current flows from the voltage source 1650 through the inductor 1630 and through the first transistor 1680. Energy is thereby stored in the inductor 1630. During a second period of time the first transistor 1680 is non-conducting and the second transistor 1681 is conducting. The energy stored in the inductor 1630 is discharged into the capacitor 1610 and the load 1699 due to the closed circuit formed by the second transistor 1681. By repeating the operation under the first period and the second period with a predetermined duty cycle the output voltage, i.e. the output voltage over the capacitor 1610 (and the load 1699) will be a positive voltage (for example +6 V). Note that the output voltage has a higher value than the voltage of the voltage source 1650. The capacitor 1610 reduces the amount of ripple in the output voltage. In the mode when the LED's should emit light, the second transistor 1681 is kept non-conducting and the third transistor 1682 is alternating conducting and non-conducting corresponding to the switching of the second transistor 1681 in the mode when the LED's should not emit light. The current which flows through the third transistor 1682 when energy stored in the inductor 1630 is discharged into the capacitor 1610 and the load 1699 will also flow through the LED's 1620–1623. During at least a part the voltage over the LED's 1620–1623 in the forward direction will reach the threshold voltage of the diodes and they will then emit light.

In an alternative embodiment an LED driver and a negative step-up circuit is formed. This is achieved by using the same type of circuit as in the seventh embodiment but with appropriate amendments to the polarities of the potentials in the circuit and the directions of the transistors and the LED's.

In a further alternative embodiment the second transistor 1681 is substituted by a diode having its anode connected to the second electrode of the inductor 1630 and its cathode connected to the first electrode of the capacitor 1610.

In the case the LED's are intended to emit light at all times the second transistor 1681 may be removed.

Referring to the fifth, sixth and seventh embodiments as described above, it should be understood that the transistors 1480–1482, 1580–1582, 1680–1682, may be implemented by using bipolar transistors.

Figure 15A:
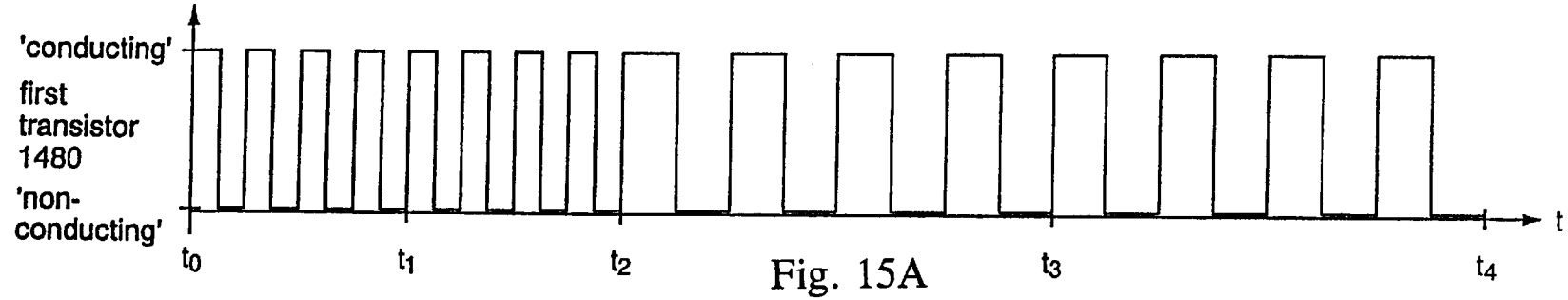
FIG. 15 is a signal diagram illustrating operational features of an LED and buzzer driver according to a eighth embodiment of the present invention.
Figure 15B:
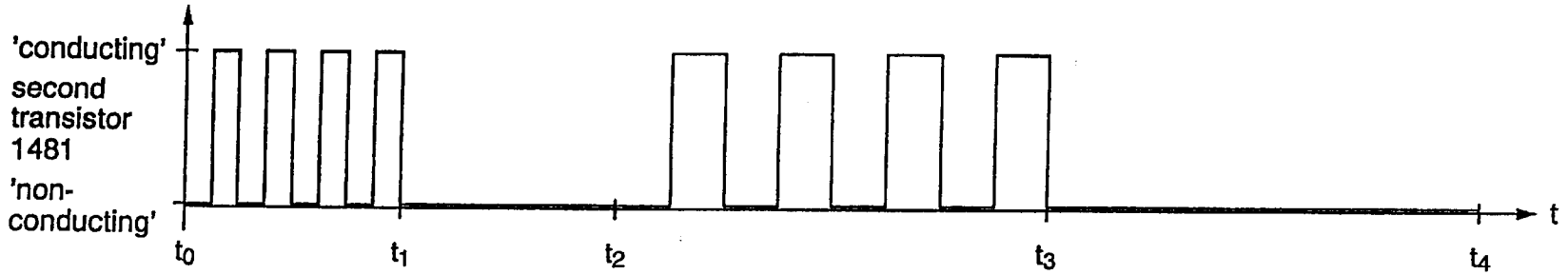
Figure 15C:
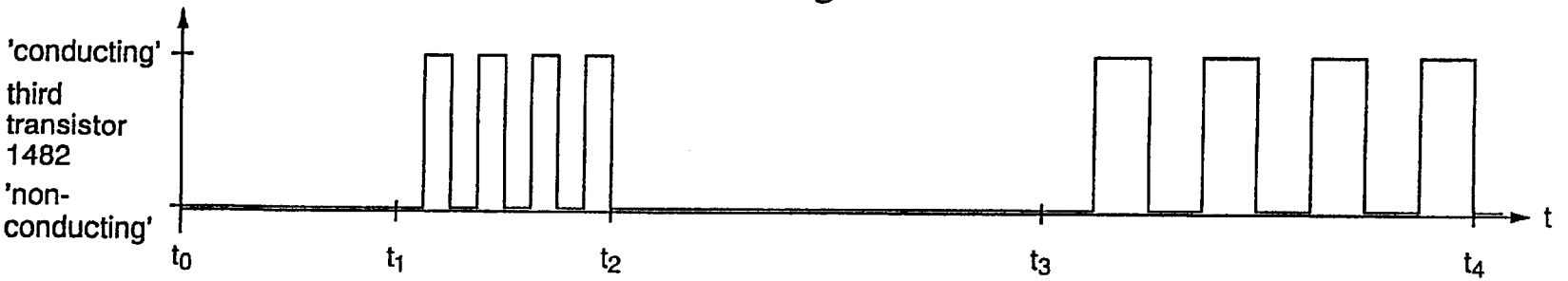

An eighth embodiment of the present invention includes an LED driver, a buzzer driver and a positive step-down (also called a "buck") circuit. In this case, the circuit in FIG. 12 of the fifth embodiment is modified in such a way that the inductor 1430 is the inductor of a buzzer (not shown). The operational features of the eighth embodiment will be described using FIG. 12 where the inductor 1430 should represent the inductor of the buzzer. FIG. 15 is a signal diagram illustrating operational features of the eighth embodiment. The states of the first, second and third transistors 1480, 1481, 1482 are illustrated as a function of time. The states are referred to as "conducting" or "non-conducting". This in turn refers to the electrical conductiveness between the drain and the source of the transistors. Four modes of operation will be discussed. The step-down circuit will be active during all four modes. A first mode of operation is illustrated between the time points t0 and t1. During this interval the buzzer will not generate an audible sound and the LED's will not be emitting light. A second mode of operation is illustrated between the time points t1 and t2. During this interval the buzzer will not generate an audible sound but the LED's will emit light. A third mode of operation is illustrated between the time points t2 and t3. During this interval the buzzer will generate an audible sound but the LED's will not emit light. Finally, a fourth mode of operation is illustrated between the time points t3 and t4. During this interval the buzzer will generate an audible sound and the LED's will emit light. As has been discussed above in conjunction with the fifth embodiment energy will be stored in the inductor 1430 during the interval when the first transistor 1480 is conducting. Next the first transistor 1480 is non-conducting and the stored energy is discharged through the capacitor 1410 and the load 1499 through the second transistor 1481 or the third transistor 1482. The LED's 1420–1423 will emit light only when the energy is discharged through the third transistor 1482. In the first and the third modes of operation the LED's should not emit light. Hence, as is shown in FIG. 15 in the time intervals t0–t1 and t2–t3, the second transistor 1481 is made conducting at periods when the energy of the inductor is discharged into the capacitor 1410 and the load 1499. In the reverse case, when the LED's should emit light as is the case in the second and fourth modes of operation, the third transistor 1482 is made conducting at periods when the energy of the inductor is discharged into the capacitor 1410 and the load 1499. This is shown in FIG. 15 in the time intervals t1–t2 and t3–t4. The frequency by which the transistors 1480, 1481, 1482 are switched between conductive and non-conductive states will determine whether the buzzer will generate an acoustic wave in the audible range or in the non-audible range. If the frequency is sufficiently high the acoustic wave will have a frequency above the highest frequency which a human may hear. The buzzer will then be experienced as being silent. Alternatively, if the buzzer stops to generate an acoustic wave at a certain frequency, for example 10000 Hz, this frequency will be sufficiently high. Such a high frequency is illustrated in FIG. 15 during the time intervals t0–t1 and t1–t2, which correspond to the first and second modes of operation. An acoustic wave which a human may hear is generated by the buzzer if the frequency is in a range corresponding to the audible range a human may hear. Such a frequency is illustrated in FIG. 15 during the time intervals t2–t3 and t3–t4, which correspond to the third and fourth modes of operation. Note that FIG. 15 is only schematically and only indicates that the frequencies with which the transistors 1480, 1481, 1482 are switched is higher in the time interval t0–t1 and t1–t2 compared to the frequencies in the time intervals t2–t3 and t3–t4. A man skilled in the art would also appreciate that the experienced frequencies generated by the buzzer may also be dependent on the duty cycle between the periods when the transistor 1480, 1481, 1482 are conducting and the periods when the transistors 1480–1482 are non-conducting.

In alternative embodiments, each of the inductors 1530, 1630, respectively, of the sixth and seventh embodiments may be substituted by an inductor of a buzzer in accordance with the modification of the fifth embodiment as discussed in the eighth embodiment.

In the case the inductor of a buzzer is used instead of the inductors 1430, 1530, 1630, of the fifth, sixth or seventh, embodiments the LED's 1420–1423, 1520–1523, 1620–1623, and the transistors 1482, 1581, 1681, which are connected in series with the LED's, may be removed to form circuits with the functionality of a buzzer in combination with a step-down circuit, a step-up circuit, a positive-to-negative polarity circuit or a negative-to positive polarity circuit. The operation of these embodiments will be similar to the operation as described in conjunction with the eighth embodiment.

Referring to any one of the previously discussed embodiments, it should be understood that the number of LED's may be different from four. Instead a number of groups of LED's, each comprising a number of LED's coupled in parallel, may be arranged in series. The parameters of the inductors and the operational frequency of the switch/switches or transistor/transistors as well as the voltage supplied by the voltage sources must, of course, be adjusted according to the number of, and the arrangement of, LED's used.

Figure 16:
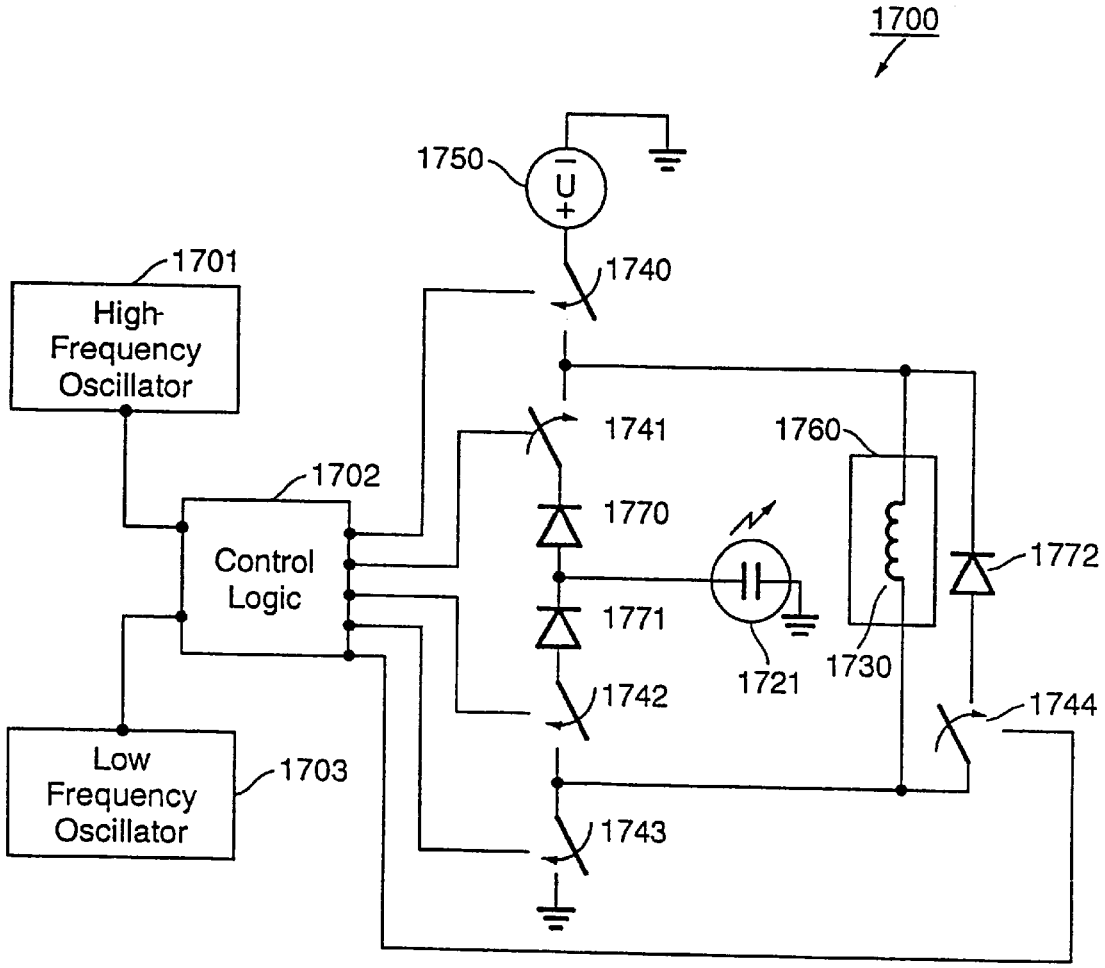
FIG. 16 illustrates a circuit diagram of an EL-lamp and buzzer driver according to an ninth embodiment of the present invention.

FIG. 16 illustrates a circuit diagram of an EL-lamp and a buzzer driver 1700 according to an ninth embodiment of the present invention. A high frequency oscillator 1701 and a low frequency oscillator 1703 are connected to a control logic 1702. Output signals from the control logic 1702 control a first, a second, a third, a fourth and a fifth switch, 1740, 1741, 1742, 1743 and 1744, respectively. A first electrode of the first switch 1740 is connected to the electrode of a voltage source 1750 having the most positive potential, "plus-pole". A second electrode the first switch 1740 is connected to a first electrode of the second switch 1741, a first electrode of an inductor 1730. A second electrode of the second switch 1741 is connected to the cathode of a first diode 1770. The anode of the first diode 1770 is connected to the cathode of a second diode 1771 and to a first electrode of an EL-lamp 1721. A second electrode of the EL-lamp 1721 is connected to the electrode of the voltage source 1750 having the most negative potential, "minus-pole". The anode of the second diode 1771 is connected to a first electrode of the third switch 1742. A second electrode of the third switch 1742 is connected to a second electrode of the inductor 1730 and to a first electrode of the fourth switch 1743. The second electrode of the fourth switch 1743 is connected to the "minus-pole" of the voltage source 1750. The cathode of a third diode 1772 is connected to the first electrode of the inductor 1730. The anode of the third diode 1772 is connected to a first electrode of the fifth switch 1744. A second electrode of the fifth switch 1744 is connected to the second electrode of the inductor 1730. The inductor forms part of a buzzer 1760.

During operation, when the EL-lamp 1721 is supposed to emit light, the potential at the first electrode of the EL-lamp 1721 is built up to be alternately positive and negative. The positive potential is achieved by setting the first switch 1740 and the third switch 1742 in closed states, the second switch 1741 and the fifth switch 1744 in open states and alternately closing and opening the fourth switch 1743. This corresponds to a boost regulator. When the fourth switch 1743 is closed a current will flow from the "plus-pole" of the voltage source 1750, through the first switch 1740, through the inductor 1730 and through the fourth switch 1743 to the "minus-pole" of the voltage source 1750. Energy will thereby be stored in the inductor 1730. When the fourth switch 1743 is open the stored energy of the inductor 1730 will be discharged through the third switch 1742 and the second diode 1771 to the EL-lamp 1721. By alternately closing and opening the fourth switch 1743 a high potential will be built up on the first electrode of the EL-lamp 1721. The negative potential is built up by setting the second switch 1741 and the fourth switch 1743 in closed states and the third switch 1742 and the fifth switch 1744 in open states and alternately closing and opening the first switch 1740. This corresponds to a buck-boost regulator (positive-to-negative potential converter). When the first switch 1740 is closed a current flows from the "plus-pole" of the voltage source 1750 through the first switch 1740, through the inductor 1730 and through the fourth switch 1743 to the "minus-pole" of the voltage source 1750. Energy will thereby be stored in the inductor 1730. When the first switch 1740 is open the stored energy will be discharged due to the closed circuit formed by the EL-lamp 1721, the first diode 1770, the second switch 1741, the inductor 1730 and the fourth switch 1743. By alternately closing and opening the first switch 1740 a high negative potential will be built up on the first electrode of the EL-lamp 1721. The frequency of opening and closing the fourth and the first switches, respectively, is chosen to be sufficiently high to allow the potential at the EL-lamp 1721 to reach a sufficiently high values such that it emits light. If the frequency is chosen to be greater than the maximum frequency of the audible range, for example 20000 Hz, there will be no risks that an acoustic wave will be generated from the buzzer 1760 when the inductor 1730 is charged and discharged with energy. This frequency is provided by the high frequency oscillator 1701. The building up of a positive and a negative potential at the first electrode of the EL-lamp 1721 is alternated with a relatively low frequency, for example, 100–400 Hz. This frequency is provided by the low frequency oscillator 1703.

During operation, when the buzzer is supposed to generate an acoustic wave, the first switch 1740 and the fifth switch 1744 are closed, the second switch 1741 and the third switch 1742 are open and the fourth switch 1743 is alternately closed and opened. When the fourth switch 1743 is closed a current flows from the "plus-pole" of the voltage source 1750, through the first switch 1740, through the inductor 1730 and through the fourth switch 1743 to the "minus-pole" of the voltage source 1750. Energy will thereby be stored in the inductor 1730. When the fourth switch 1743 is open the stored energy will be discharged partly due to the generation of an acoustic wave by a membrane (not shown) and partly through the closed circuit of the inductor 1730, the fifth switch 1744 and the third diode 1772.

In an alternative embodiment the third diode 1772 and the fifth switch 1744 are removed. During operation, when the EL-lamp 1721 is supposed to emit light, the first, second, third and fourth switches are controlled as described above. However, during operation, when the buzzer 1760 is supposed to generate an acoustic wave, the frequency of the high frequency oscillator 1701, which controls the frequency of the opening and closing of the fourth switch 1743 and the first switch 1740 is lowered to a frequency within the audible range. The buzzer 1760 will then generate an audible acoustic wave.

It should be understood that any one of the first, second, third, fourth and fifth switches, 1740, 1741, 1742, 1743 and 1744, respectively, may be implemented by using any kind of transistors such as bipolar transistors or field effect transistors.

The constructions of the driver circuits in the above mentioned embodiments achieve the advantage that the space on a PCB required by two or more drivers is smaller than when the same number of drivers are realized separately. Furthermore, the constructions achieve the advantage that a smaller number of signals for controlling the drivers are required compared to the number of signals for controlling the same number of drivers when these are realized separately.

The smaller space required on the PCB is the result of the fact that a smaller number of components (inductors and switches) are needed for the driver circuit of the present invention compared to the number of inductors needed for the prior art drivers when the same amount of drivers are used. Furthermore, when the components of the driver circuit for driving at least two functional means are mounted on a PCB, less time is required by a resource for mounting the components on a PCB, such as a pick-and-place machine, since a smaller number of components are required compared to when the same number of drivers are realized separately. Furthermore, the required space on the PCB is also reduced due to the fact that a smaller number of control signals need to be realized on the PCB. When these control signals are generated by output ports of for example a micro-processor the PCB space required is further reduced because a smaller number of output ports need to be realized on the PCB. The smaller number of control signals and possibly the number of output ports required is also a result of the method of operating the driver circuit of the present invention where the operation of more than one functional means may be controlled by the use of one control signal by changing the frequency of the control signal.

We claim:

1. A driver circuit for selectively activating one of a plurality of functional devices, comprising:

an inductor that when discharged activates a first functional device;

switching means that in a first switching state, causes a charge current to flow for charging the inductor, and in a second switching state, causes the inductor to be discharged, wherein said switching means is responsive to a control signal for switching between the first and second switching states according to a selectable frequency of operation that sets the frequency by which the first functional device is activated; and a control logic that generates the control signal for selecting the frequency of operation of the switching means for selectively activating at least one of the plurality of functional devices.

2. A driver circuit according to claim 1, wherein the first functional device is a buzzer that generates an acoustic wave when the inductor is discharged.

3. A driver circuit according to claim 2, wherein the control logic generates the control signal for selecting the frequency of operation such that the buzzer generates an audible acoustic wave.

4. A driver circuit according to claim 2, wherein the control logic generates the control signal for selecting the frequency of operation such that the buzzer generates a non-audible acoustic wave.

5. A driver circuit according to claim 1, wherein one of the plurality of functional devices is a light emitting diode which emits light when the inductor is discharged.

6. A driver circuit according to claim 1, wherein the first functional devices is a voltage conversion circuit which generates a pre-determined voltage when the inductor is discharged.

7. A driver circuit according to claim 6, wherein the voltage conversion circuit is a step-down converter.

8. A driver circuit according to claim 6, wherein the voltage conversion circuit is a step-up converter.

9. A driver circuit according to claim 1, wherein the control logic controls the switching means to discharge the inductor to activate at least two selected functional devices during two different periods of time.

10. A driver according to claim 1, wherein the switching means includes at least one transistor switch.

11. A method of operating a driver circuit selectively activating one of a plurality of functional devices comprising the steps of:

charging an inductor by placing a switching means in a first switching state;

discharging the inductor by placing the switching means in a second switching state to activate at least a first functional device;

switching between the first and second switching states according to a selectable frequency of operation that sets the frequency by which the first functional device is activated; and selecting the frequency of operation of the switching means to selectively activate at least one of the plurality of functional devices.

12. A method according to claim 11, wherein the step of selecting includes selecting the frequency of operation of the switching means to generate an audible acoustic wave by the first functional device.

13. A method according to claim 11, wherein the step of selecting includes selecting the frequency of operation of the switching means to generate a non-audible acoustic wave by the first functional device.

14. A method according to claim 11, wherein the step of discharging includes placing the switching means in the second switching state to activate a light emitting device.

15. A method according to claim 11, wherein the step of discharging includes placing the switching means in the second switching state to activate a voltage conversion circuit.

16. A method according to claim 15, wherein the voltage conversion circuit is a step-down converter.

17. A method according to claim 15, wherein the voltage conversion circuit is a step-up converter.

18. A method according to claim 11 further including the step of controlling the switching means to the discharge the inductor to activate at least two selected functional devices during two different periods of time.

* * * * *